US006571413B1

(12) United States Patent
Stjerna

(10) Patent No.: US 6,571,413 B1
(45) Date of Patent: Jun. 3, 2003

(54) SPRING MATTRESS

(75) Inventor: Nils Eric Stjerna, Herrljunga (SE)

(73) Assignee: Stjernfjadrar AB, Herrljunga (SE)

( * ) Notice: Subject to any disclaimer, the term of this patent is extended or adjusted under 35 U.S.C. 154(b) by 0 days.

(21) Appl. No.: 09/700,662

(22) PCT Filed: Apr. 20, 1999

(86) PCT No.: PCT/SE99/00623

§ 371 (c)(1),
(2), (4) Date: Nov. 17, 2000

(87) PCT Pub. No.: WO99/59449

PCT Pub. Date: Nov. 25, 1999

(30) Foreign Application Priority Data

May 19, 1998 (SE) ..... 9801762

(51) Int. Cl.[7] ..... A47C 23/04
(52) U.S. Cl. ..... 5/716; 5/269; 5/727
(58) Field of Search ..... 5/716, 717, 727, 5/269

(56) References Cited

U.S. PATENT DOCUMENTS

| | | | | | |
|---|---|---|---|---|---|
| 1,261,655 | A | | 4/1918 | Vallone | |
| 1,418,469 | A | | 6/1922 | Reidenbach | |
| 2,033,841 | A | * | 3/1936 | Maddux | 5/716 |
| 3,092,849 | A | * | 6/1963 | Clifton | 5/716 |
| 5,953,778 | A | * | 9/1999 | Hiatt | 5/716 |
| 6,065,168 | A | * | 5/2000 | Damron | 5/716 |

FOREIGN PATENT DOCUMENTS

| | | |
|---|---|---|
| DE | 1028759 | 4/1958 |
| GB | 288820 | 4/1928 |
| GB | A430564 | 6/1935 |
| NO | C059281 | 4/1938 |
| NO | C005636 | 2/1997 |
| NO | C008325 | 10/1999 |

* cited by examiner

*Primary Examiner*—Alexander Grosz
(74) *Attorney, Agent, or Firm*—Birch, Stewart, Kolasch & Birch, LLP

(57) ABSTRACT

A spring mattress including a plurality of interconnected coil-spring elements, said coil-spring elements being interconnected by securing elements, preferably in the form of spirals, which, at least in one plane essentially in parallel with the plane of the mattress, extend between and are attached to pairs of neighboring spring elements, thus interconnecting these spring elements. A method of manufacturing a mattress, wherein at least some of the securing elements in the longitudinal direction are subdivided into independent segments.

13 Claims, 2 Drawing Sheets

SPRING MATTRESS

This application is the national phase under 35 U.S.C. §371 of PCT International Application No. PCT/SE99/00623 which has an International filing date of Apr. 20, 1999, which designated the United States of America.

TECHNICAL FIELD

The present invention relates to a spring mattress comprising a plurality of interconnected coil-spring elements, said coil-spring elements being interconnected by means of securing elements, preferably in the form of spirals, which, at least in one plane essentially in parallel with the plane of the mattress, extend between and are attached to pairs of neighbouring spring elements, thus interconnecting these spring elements. The invention also relates to a method of manufacturing a mattress of this kind.

BACKGROUND

Conventionally, in the manufacture of spring mattresses comprising layers of coil springs arranged between the bed frame and the surface of the mattress, the springs are joined together at the spring ends. Usually springs of the kind known as Bonnell springs are used, wherein neighbouring springs are interconnected in pairs by means of spirals of considerable length, which are coiled about the adjacent parts of turns in the respective neighbouring spring. Thus, the spirals extend in parallel with the surface of the mattress, i.e. across the centre axes of the springs, either in the length or width direction of the mattress.

This classical mattress does, however, suffer from a number of disadvantages. Since the spirals lock turns in neighbouring springs together rather firmly, the springs fail to be individually resilient. As a result, load on one of the springs of the mattress will cause deflection not only of that spring but also of neighbouring springs. This is a disadvantage, as it detracts from the adaptability of the mattress and because the latter will not distribute the supporting force evenly across the user's entire body surface, and in consequence the mattress is felt as being less comfortable.

It is likewise known to divide the mattress into several sections, which are essentially independent from one another. This arrangement is described in DE 1 028 759 and GB 288 820. However, the primary object of this arrangement is not to increase the user's comfort, but to make repair of the bed, when worn out, more convenient and less expensive. These prior-art mattress constructions do not make the springs individually resilient and do not contribute in any essential degree to the comfort of the bed.

OBJECT OF THE INVENTION

In view hereof, one object of the invention is to provide a spring mattress of the kind defined in the introduction but wherein the disadvantages found in prior-art mattresses of this type have been completely or at least partly removed.

This object is achieved by means of a spring mattress and a method of producing this mattress as defined in the appended claims.

BRIEF DESCRIPTION OF THE DRAWINGS

For exemplifying purposes, some embodiments of the invention will be described in more detail in the following with reference to the accompanying drawings, which are given by way of illustration only, and thus are not limitative of the present invention, and wherein.

DESCRIPTION OF PREFERRED EMBODIMENTS

Figure 1:
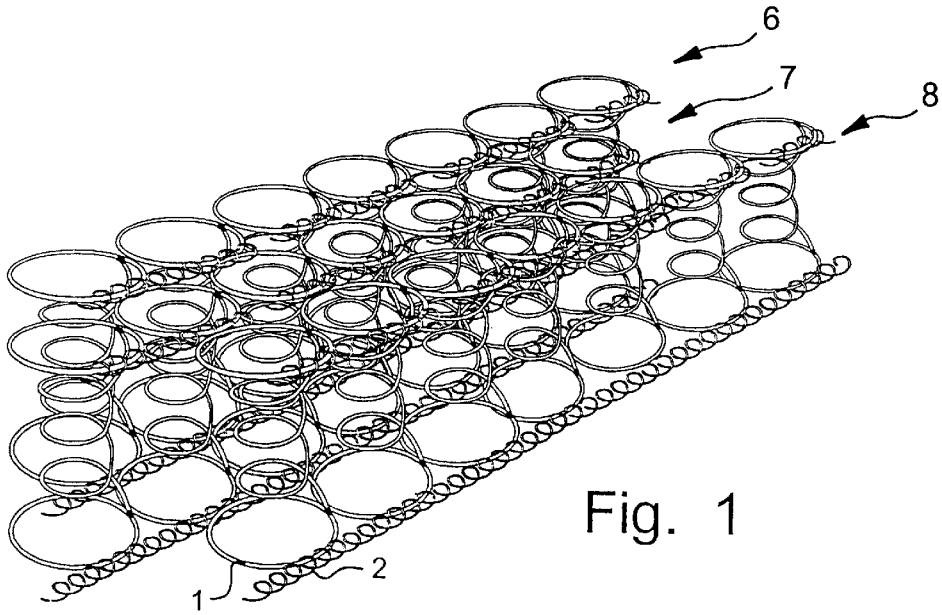
FIG. 1 is a perspective view of a part of a spring mattress in accordance with one embodiment thereof.
Figure 2:
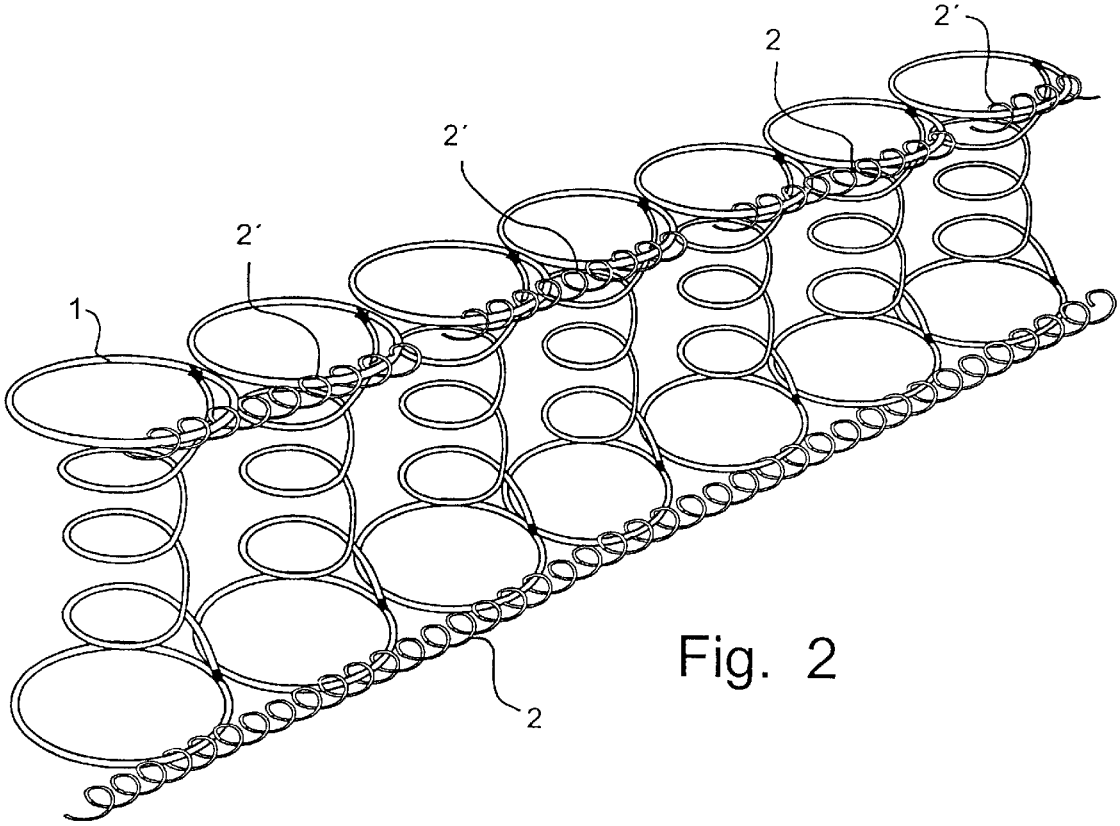
FIG. 2 is a perspective view of a row of coil springs incorporated in tile spring mattress of FIG. 1.
Figure 3:
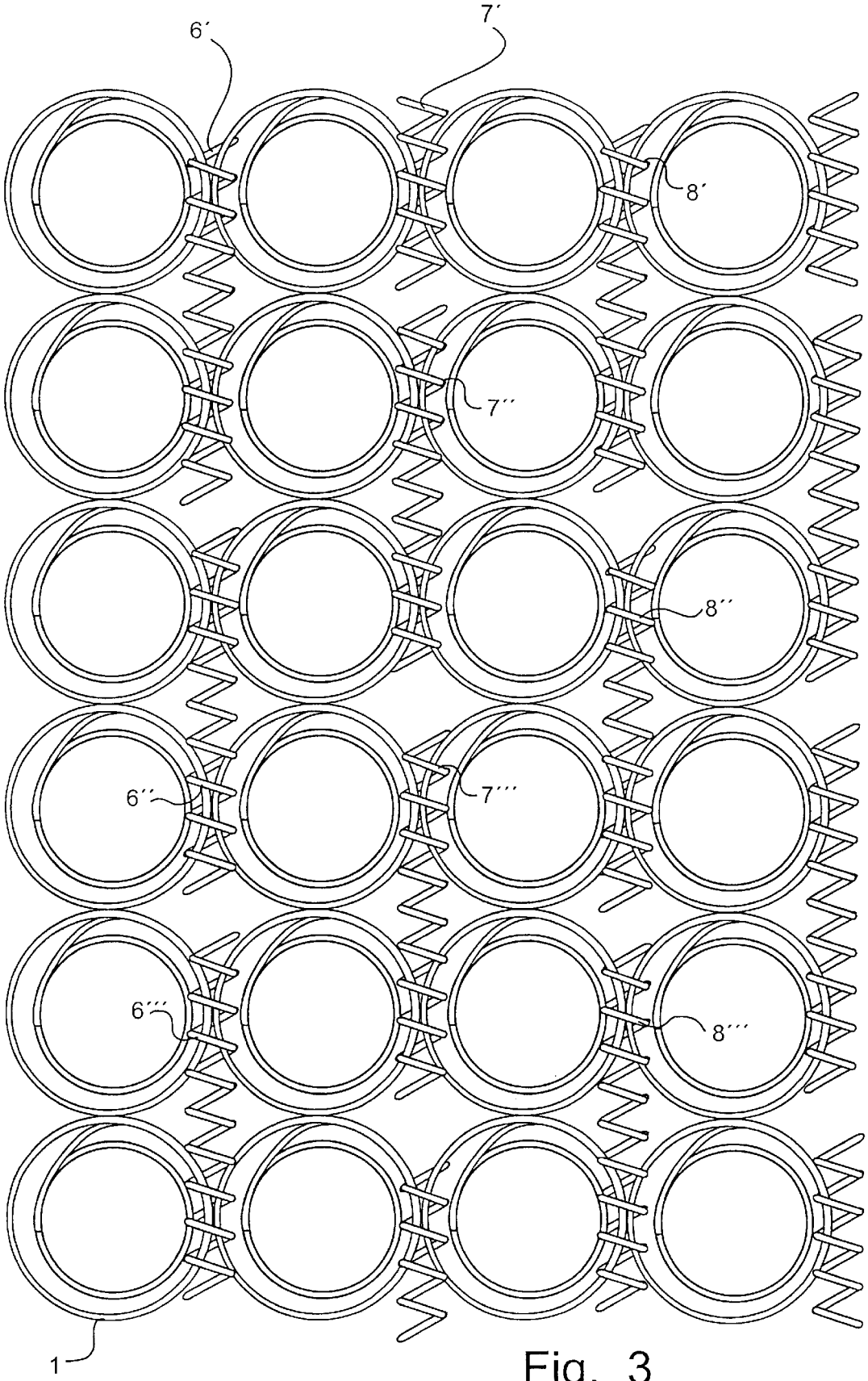
FIG. 3 is a plan view from above of the mattress of FIG. 1.

FIGS. 1–3 show a part of a spring mattress in accordance with the invention. The inventive mattress comprises a layer of coil-spring elements 1, in the present case coil springs extending between the bed frame and the upper surface of the mattress.

The springs 1 are interconnected by means of securing elements 2, which are attached to and between two turns of neighbouring springs. According to the shown embodiment, the securing elements are coil springs, which are wound in such a way that they engage turns of the coil springs 1. The thus interconnected turns preferably are the two end turns of each coil spring. However, it is likewise possible to instead interconnect other intermediate turns of the springs. The turns to be interconnected preferably are larger than the rest of the turns of the spring, i.e. they have a larger radial extension. Owing to this larger size, they may be interconnected without the other parts of the springs abutting against one another when the springs are exposed to load. Preferably, springs of the so called double-cone configuration are used, i.e. springs the top and bottom turns of which are wider than the rest of the turns, as is the case in conventional Bonnell spring carcasses. Finally, these turns of the spring, which are intended to be interconnected in accordance with the invention, also preferably are flat, i.e. they extend in a plane that essentially is perpendicular to the centre axis of the spring.

In accordance with the invention, the spirals are placed along successive lines 6, 7, 8, which are arranged in inter-parallel relationship and extend in parallel with the plane of the mattress.

In accordance with the invention, at least some of the spirals are subdivided into inter-independent segments 2'. Preferably, these segments have a length allowing them to interconnect several pairs of neighbouring springs, for example two or three pairs of adjoining springs. In this manner the springs in the mattress are held together in all directions and cooperate to absorb compressive load exerted on the mattress while at the same time the springs may be compressed comparatively independently. This latter property is desirable, both for reasons of comfort and for preventing displacement of the mattress, when a load compresses the mattress middle downwards. By the expression "inter-independent segments" as used above should be understood that the segments are not connected to one another directly, although obviously they are indirectly interconnected by way of the coil springs.

The feature of sub-dividing the spirals in the manner indicated above, such that each spring is connected only to a small number of other springs, is important above all in the part of the layer that is turned towards the surface of the mattress, i.e. upwards as seen in the drawing figures. On the other hand, at the opposite end, this sub-division is unnecessary, since the springs are not to be compressed from this direction. On the contrary, it may even be desirable to refrain from such a sub-division at this end, as it contributes to holding the mattress together and to the firmness and stability of the mattress. Consequently, the spirals on the upper face preferably are sub-divided in the manner indicated whereas the spirals on the bottom face are not. The terms "upper face" and "bottom face", are used herein only with reference to the shown embodiment. Obviously, also the bottom face could be used as the "upper face" that is turned towards the user. In this manner, the mattress also becomes reversible, allowing the user, by choosing which mattress side is to be turned upwards, to affect the properties of resilience and the adaptability of the mattress. A reversible mattress of this kind preferably also could be fitted on the upper and bottom faces with surface layers exhibiting mutually different qualities. The surface layers could, for instance, be padded differently, and consequently exhibit different thickness and hardness.

Preferably, the spirals are disposed in staggered relationship in the different lines 6, 7, 8 in the direction of extension of the individual lines. Thus, as shown in the illustrated embodiment, the spirals 6' in line 6 may be positioned in lateral alignment with the spirals 8' in line 8, spirals 6" in lateral alignment with spirals 8", and so on, whereas spirals 7' and 7" and so on, positioned in line 7 intermediate lines 6 and 8, are displaced relative to the spirals in lines 6 and 8 by a distance corresponding to one pair of springs. This staggered arrangement improves the stability and the integrity of the springs of the mattress.

By sub-dividing the securing elements in the manner described above it likewise becomes possible to give the mattress different properties. The properties may be determined for instance by the designer deciding how many of the securing elements in the mattress are to be sub-divided, where such sub-divided elements are to be positioned, and how long or short the segments are to be. In this manner, i.e. by arranging the discontinuities or gaps between the spiral segments in different ways across the surface of the mattress, it becomes possible, by using the same basic material, to produce mattresses having varying properties, and also to produce mattresses exhibiting different properties across the surface of the mattress. In the latter case, it consequently becomes possible to produce in the mattress zones of different nature, which zones exhibit properties of resilience that differ from one zone to the next, in order better to adapt the mattress to the user's individual needs and requirements.

The above-described mattress preferably is produced in the conventional manner, according to which the spring carcasses are first manufactured, whereupon the carcasses are interconnected by winding-on the spirals onto the carcasses, the spirals being continuously severed in the desired places. It should be appreciated that this sub-division of the spirals may be effected afterwards, when the mattresses are already assembled, or in advance, before the spirals are wound onto the spring carcasses.

By means of the spring mattress and the method of producing the same according to the invention a mattress is obtained which is simple yet adaptable and which is also individually resilient and consequently more comfortable. This mattress is felt as being softer, since it distributes the pressure across the entire surface of contact of the person using the bed more efficiently.

The invention has been described herein by way of one embodiment. Other varieties of the invention are, however possible. For example, other securing elements than spirals may be used. It is likewise possible to interconnect the springs at turns at intermediate spring coils rather than at the external turns. Such modifications must be regarded as obvious and to be within the scope of protection of the invention as the latter is defined in the appended claims.

What is claimed is:

1. A spring mattress comprising a plurality of interconnected coil-spring elements, said coil-spring elements being interconnected by securing elements, which, at least in one plane are essentially in parallel with the plane of the mattress, the securing elements extend between and are attached to pairs of neighboring spring elements, thus interconnecting the spring elements, at least some of the securing elements are subdivided into independent segments, and the subdivided independent segments are arranged distributed over the mattress, the independent segments in a first row of independent segments being staggered with respect to the independent segments in a second row of independent segments, whereby the springs of the mattress become comparatively independently compressible.

2. The spring mattress as claimed in claim 1, wherein the spring elements have top and bottom ends and wherein the securing elements are arranged at least at one of the ends of the spring elements, and are subdivided at only one of said ends.

3. The spring mattress as claimed in claim 2, wherein the securing elements are arranged at the bottom and top ends of said spring elements.

4. The spring mattress as claimed in claim 1, wherein at least some of the subdivided securing elements extend between several pairs of coil springs.

5. The spring mattress as claimed in claim 1, wherein there are a plurality of rows of said first row of independent segments and a plurality of rows of said second row of independent segments arranged along lines which extend in parallel with one another, each of said plurality of independent segments in each of said first rows being arranged in a staggered relationship with respect to each of said plurality of independent segments in each of said second rows.

6. The spring mattress as claimed in claim 1, further comprising zones having different properties of resilience, the zones being distributed across the surface of the mattress, said zones being achieved by location of the subdivided securing elements and a length of the segments.

7. The spring mattress of claim 1, wherein the securing elements for interconnecting the coil-spring elements are spirals.

8. A method of producing a spring mattress, comprising the step of interconnecting a plurality of coil springs by elongated securing elements, in such a manner that they are fastened to one another, said securing elements being disposed between springs in a plane essentially in parallel with the plane of the mattress and being secured to neighboring springs, wherein the securing elements are subdivided into independent segments, and wherein such subdivided independent segments are arranged distributed over the mattress, the independent segments in a first row of independent segments being staggered with respect to the independent segments in a second row of independent segments, whereby the springs of the mattress become comparatively independently compressible.

9. The method as claimed in claim 8, wherein there are a plurality of rows of said first row of independent segments and a plurality of rows of said second row of independent segments each of said plurality of independent segments in each of said first rows being arranged in a staggered relationship with respect to each of said plurality of independent segments in each of said second rows.

10. The method as claimed in claim 8, wherein the step of interconnecting a plurality of coil springs comprises interconnection by spirals.

11. A spring mattress comprising a plurality of interconnected coil-spring elements, said coil-spring elements being interconnected by securing elements, which, at least in one plane are essentially in parallel with the plane of the mattress, the securing elements extend between and are attached to pairs of neighboring spring elements, thus interconnecting the spring elements, at least some of the securing elements are subdivided into independent segments, so that essentially all springs are connected only to a small number of other springs by said securing elements, the independent segments in a first row of independent segments being staggered with respect to the independent segments in a second row of independent segments.

12. A method of producing a spring mattress, comprising the step of interconnecting a plurality of coil springs by elongated securing elements, in such a manner that they are fastened to one another, said securing elements being disposed between springs in a plane essentially in parallel with the plane of the mattress and being secured to neighboring springs, wherein the securing elements are subdivided into independent segments, so that essentially all springs are connected only to a small number of other springs by said securing elements, the independent segments in a first row of independent segments being staggered with respect to the independent segments in a second row of independent segments.

13. A spring mattress comprising a unitary coil-spring unit with coil-springs are interconnected by securing elements which extend between and are attached to pairs of neighboring coil-springs, thus interconnecting these spring elements, wherein at least some of the securing elements are subdivided into independent segments, the independent segments in a first row of independent segments being staggered with respect to the independent segments in a second row of independent segments.

* * * * *